US009786477B1

(12) United States Patent
Zaleski et al.

(10) Patent No.: US 9,786,477 B1
(45) Date of Patent: Oct. 10, 2017

(54) GAS FLOW ASSISTED ION TRANSFER SYSTEM WITH IMPROVED TRANSFER EFFICIENCY

(71) Applicant: Smiths Detection, Inc., Edgewood, MD (US)

(72) Inventors: Henryk Zaleski, Scarborough (CA); Reno DeBono, Clinton, NJ (US)

(73) Assignee: Smiths Detection Inc., Edgewood, MD (US)

( * ) Notice: Subject to any disclaimer, the term of this patent is extended or adjusted under 35 U.S.C. 154(b) by 0 days.

(21) Appl. No.: 15/198,126

(22) Filed: Jun. 30, 2016

(51) Int. Cl.

| | |
|---|---|
| ***H01J 49/04*** | (2006.01) |
| ***H01J 49/24*** | (2006.01) |
| ***H01J 49/10*** | (2006.01) |
| ***H01J 49/06*** | (2006.01) |

(52) U.S. Cl.
CPC ..... *H01J 49/0404* (2013.01); *H01J 49/062* (2013.01); *H01J 49/10* (2013.01); *H01J 49/24* (2013.01)

(58) Field of Classification Search
USPC ..... 250/283, 288
See application file for complete search history.

(56) References Cited

U.S. PATENT DOCUMENTS 8,686,351 B2 4/2014 Ouyang et al.
8,963,079 B2 2/2015 Ouyang et al.
9,159,540 B2 10/2015 Ouyang et al.
2008/0087812 A1* 4/2008 Musselman ..... H01J 49/0404 250/285
2012/0156712 A1* 6/2012 Takats ..... G01N 1/02 435/29

OTHER PUBLICATIONS

Garimella, Sandilya et al., "Gas-flow assisted ion transfer for mass spectrometry", J. Mass Spectrom. 2012, 47, 201-207.
He, Jiuming et al., "Air flow assisted ionization for remote sampling of ambient mass spectrometry and its application", Rapid Commun. Mass Spectrom. 2011, 25, 843-850 (Abstract Only).
International Search Report and Written Opinion dated Aug. 2, 2017 for PCT/US17/40197.

* cited by examiner

*Primary Examiner* — Kiet T Nguyen
(74) *Attorney, Agent, or Firm* — Advent, LLP

(57) ABSTRACT

An ion transfer system includes an ion source coupled to an ion inlet; an ion transfer tube assembly including a concentric ion transfer tube with a porous material that is permeable to a gas, the concentric ion transfer tube coupled to the ion inlet and the ion source, where a first gas that includes an ion stream flows through the concentric ion transfer tube; and a concentric gas tube, the concentric ion transfer tube disposed within the concentric gas tube, where a second gas flows between the concentric ion transfer tube and the concentric gas tube; an ion detection device coupled to a capillary tube that is coupled to the concentric ion transfer tube, where the capillary tube transports the ion stream to the ion detection device; and a pump coupled to at least one of the concentric ion transfer tube or the concentric gas tube.

20 Claims, 7 Drawing Sheets

GAS FLOW ASSISTED ION TRANSFER SYSTEM WITH IMPROVED TRANSFER EFFICIENCY

FEDERALLY SPONSORED RESEARCH OR DEVELOPMENT

This invention was made with Government support under contract HSHQDC-15-C-B0027 with the U.S. Department of Homeland Security. The Government has certain rights in this invention.

BACKGROUND

The present disclosure relates to mass spectrometry and more particularly to remote ionization and ion transfer.

Mass spectrometers (MS) operate in a vacuum and separate ions with respect to mass-to-charge ratio. In embodiments that use a mass spectrometer, a sample, which may be solid, liquid, or gas, is ionized. The ions are separated in a mass analyzer according to mass-to-charge ratio and are detected by a device capable of detecting charged particles. The signal from the detector is then processed into the spectra of the relative abundance of ions as a function of the mass-to-charge ratio. The molecules are identified by correlating the identified masses with known masses or through a characteristic fragmentation pattern.

SUMMARY

An ion transfer tube assembly, an ion transfer system, and a method for providing an ion stream within an ion transfer system are described that include using multiple concentric tubes, one tube disposed within the other tube. In an implementation, an ion transfer tube assembly that employs example techniques in accordance with the present disclosure includes a concentric ion transfer tube, the first concentric ion transfer tube including a porous material that is permeable to a gas, and the first concentric ion transfer tube coupled to an ion inlet and an ion source, where a first gas that includes an ion stream and/or neutral molecules flows through the concentric ion transfer tube to an ion detection device; and a concentric gas tube, the concentric ion transfer tube disposed within the concentric gas tube, where a second gas flows between the concentric ion transfer tube and the concentric gas tube in an annular space.

In an implementation, an ion transfer system that employs example techniques in accordance with the present disclosure includes an ion source coupled to an ion inlet; an ion transfer tube assembly including a concentric ion transfer tube, the first concentric ion transfer tube including a porous material that is permeable to a gas, and the first concentric ion transfer tube coupled to an ion inlet and an ion source, where a first gas that includes an ion stream and/or neutral molecules flows through the concentric ion transfer tube; and a concentric gas tube, the concentric ion transfer tube disposed within the concentric gas tube, where a second gas flows between the concentric ion transfer tube and the concentric gas tube in an annular space; an ion detection device coupled to a capillary tube, the capillary tube coupled to the concentric ion transfer tube, where the capillary tube transports the ion stream and/or neutral molecules from the concentric ion transfer tube to the ion detection device; and a pump coupled to at least one of the concentric ion transfer tube or the concentric gas tube.

In an implementation, a method for providing an ion stream within an ion transfer system that employs example techniques in accordance with the present disclosure includes providing the ion stream using an ion source, an ion inlet coupled to the ion source, from the ion inlet through a concentric ion transfer tube to a capillary tube coupled to a mass spectrometer, the ion stream and/or neutral molecules flowing within a first gas from the ion inlet to the capillary tube, where the concentric ion transfer tube includes a porous material that is permeable to gas; and providing a second gas within a concentric gas tube, the concentric ion transfer tube within the concentric gas tube, where the second gas flows through an annular space disposed between the concentric ion transfer tube and the concentric gas tube and permeates into the concentric ion transfer tube.

In the above implementations, the loss of ions and/or neutral molecules on the walls of an ion transfer tube can be reduced by creating a flow of gas through the concentric ion transfer tube causing a flow within the concentric ion transfer tube that is radially inward and actively pushes ions and/or neutral molecules away from the tube wall. The net effect of the radially inward flow described above is the reduction of the total ion flux to the walls and reduced ion losses resulting in a more accurate ion concentration measurement.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. The use of the same reference number in different instances in the description and the figures may indicate similar or identical items.

DETAILED DESCRIPTION

Overview

Figure 1A:
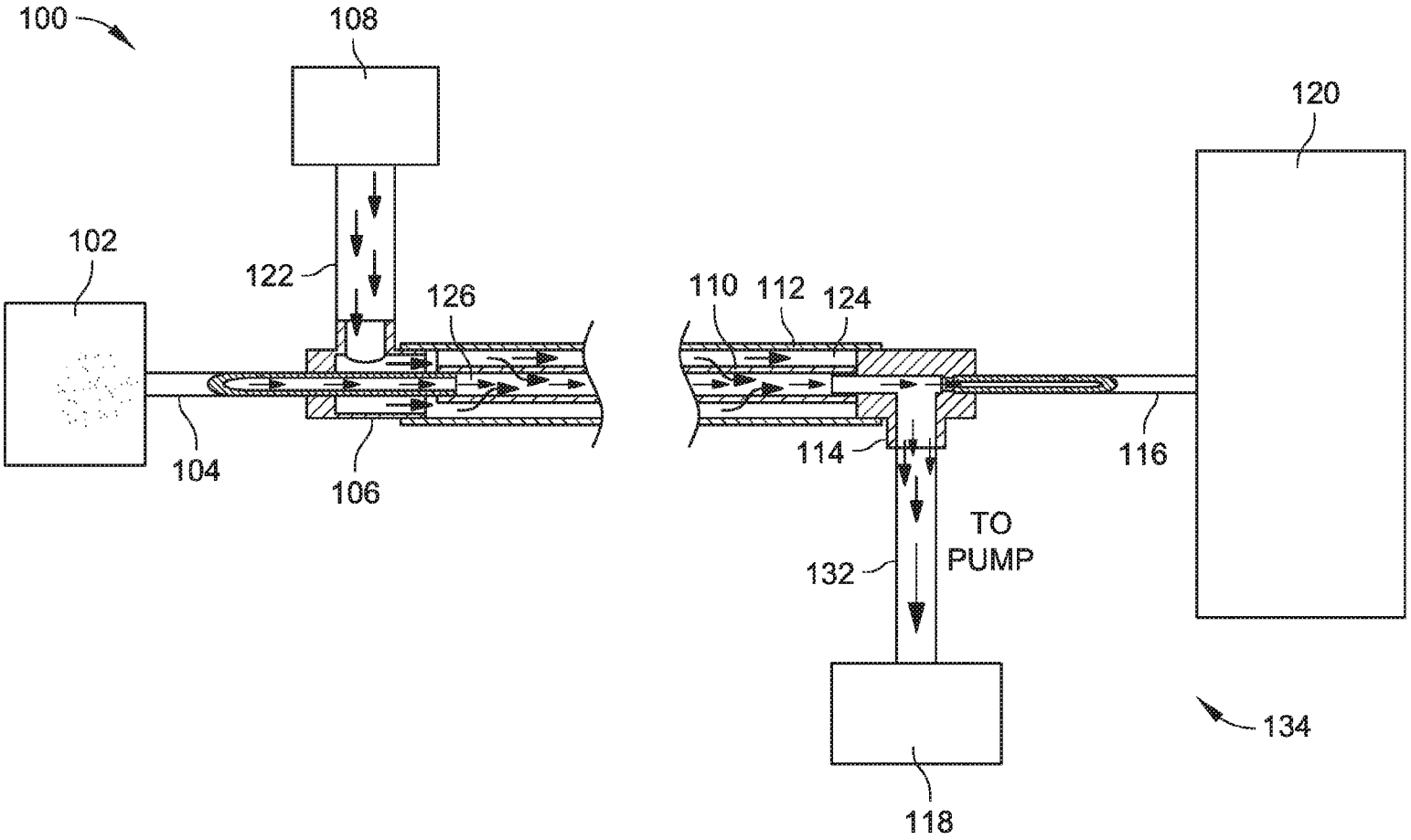
FIG. 1A is a diagrammatic cross-sectional view illustrating an ion transfer system and ion transfer tube assembly including a porous concentric ion transfer tube within a concentric gas tube in accordance with an example implementation of the present disclosure.

Mass spectrometers (MS) operate in a vacuum and separate ions with respect to the mass-to-charge ratio. In implementations using a mass spectrometer, a sample, which may be a solid, a liquid, or a gas, is ionized and analyzed. The ions are separated in a mass analyzer according to mass-to-charge ratio and are detected by a detector capable of detecting charged particles. The signal from the detector is then processed into the spectra of the relative abundance of ions as a function of the mass-to-charge ratio. The molecules are identified by correlating the identified masses with known masses or through a characteristic fragmentation pattern.

Ambient ionization methods can be used in an MS or ion-mobility spectrometry (IMS) system to ionize substances for real-time and in situ chemical analysis without any sample preparation. Among them include desorption electrospray ionization (DESI), direct analysis in real-time (DART), low-temperature plasma (LTP), electrospray (ES), direct atmospheric pressure chemical ionization (DAPCI) and many others. In a typical example, an ion source, such as DART, is positioned in proximity of the material to be analyzed and generates ions. These ions are then carried to the analyzing device, such as a mass spectrometer, by a flow of air or other gas through a tube. As the ions are carried along the tube, they also diffuse across the gas flow stream towards the walls of the tube where they lose their charge and cannot be detected by the mass spectrometer.

The ion loss, and therefore, the efficiency of ion transfer by a gas flow depends on at least the following:

- Length of the tube—the longer the tube the higher losses;
- Diffusion coefficient of ions—higher diffusion coefficient increases the losses;
- Gas flow rate—higher flow rate reduce the losses by reducing transit time of ions in the tube; and
- Flow pattern—the lowest losses are with the laminar flow where flow velocity is parallel to the direction of the tube. Any deviation from that, due to for instance turbulences, eddies, etc. increase the losses.

For a laminar flow in a perfectly straight tube, an analytical solution to the transmission efficiency of ions carried by the flow includes the following formula.

$$T(L) = \frac{n(L)}{n_0} = \exp\left(-11.5\frac{D \cdot L}{F}\right)$$

In the above formula, T(L) is the transmission efficiency defined as the ratio of the ion concentration at the end of the tube n(L) to the initial ion concentration no, and D is the diffusion coefficient, L is the length of the tube and F is the volumetric flow rate. The above formula is valid for a long tube with perfectly laminar flow. Any flow deviation will increase the ion losses and reduce the transmission efficiency.

In one example using the above formula, a transfer of explosive ions can be produced by an LTP source. The diffusion coefficients for typical explosive ions, such as TNT or NG at ambient conditions, are approximately 0.05 $cm^2/s$. A typical flow rate into a mass spectrometer can be about 600 $cm^3/min$ (10 $cm^3/s$). With a tube length of 60 cm, the transmission efficiency calculated from the formula is only 0.32%. In principle, the transmission efficiency can be improved by increasing the gas flow rate.

Additionally, neutral molecules, especially neutral molecules of semi-volatile substances, may be transported from an ion source and/or sample by a flow of air or other gas through a transfer tube. The neutral molecules can be ionized between the outlet of the transfer tube and the mass spectrometer inlet or within the vacuum chamber of the mass spectrometer. Semi-volatile substances are solid or liquid at ambient conditions but can be vaporized by application of heat (thermal desorption), light (photo desorption), or obtained by reaction of non-volatile substances with volatizing agents. As the neutral molecules are carried along the tube, they diffuse across the gas flow stream towards the walls of the tube where they are absorbed onto the surface of the walls and/or are absorbed by the bulk of the transfer tube. When the neutral molecules are absorbed by the surface and/or the bulk of the transfer tube, the neutral molecules do not reach the inlet of an analysis device (e.g., mass spectrometer) and are not available for analysis.

There are significant technical challenges for providing efficient transfer of low abundance analyte ions and neutral molecules of interest from an ionization source into ion detection system over a long distance, especially in the case of a miniature mass analyzer. The challenges are mainly related to size and weight limitations of portable systems, which severely limit the choice of vacuum pumps that can be used in such systems. Small vacuum pumps limit the intake flows into a mass spectrometer to about 0.15 L/min. The main mechanism of ion losses in long narrow tubing at ion concentrations less than $10^8$ $cm^{-3}$ is radial diffusion to the walls (see Lin, B.; Sunner, J., Ion transport by viscous gas flow through capillaries, *J Am Soc Mass Spectrom,* 1994, 5, 873-885), which is incorporated herein by reference.

In many instances it is not feasible to place analyzed samples in front of a mass spectrometer inlet. In this case generated ions and neutral molecules need to be transferred over the long distance without significant loss of analyte signal. Previous technologies either use the MS spectrometer typical inlet flow rate to transport ions and neutral molecules or add an extra gas flow to increase the flow rate and, according to the formula, reduce losses exponentially. However, in practice, the gains obtained by the use of extra flow are limited. Transmission efficiency improves up to about 2 liter per minute (LPM) of added flow, then the gains tend to level off. One reason includes sample dilution by the extra flow. Another reason includes that with the increased flow rate and thus velocity, it is much more difficult to maintain perfectly laminar flow.

A practical device will not be a perfect tube with a constant diameter. There are elements like inlet, outlet, fittings where the diameter changes. The ion transfer tube may have curvature, could be deformed, etc. Any such deviations from the perfectly straight tube will cause the flow to deviate from the perfectly laminar pattern due to the inertia of the moving gas. The increased flow rate increases the ratio of inertial forces to the viscous forces (expressed as Reynolds number). With the increased Reynolds number, deviations from perfectly laminar flow increase and result in higher loss rate than what is predicted by the above formula.

Accordingly, an ion transfer tube assembly, an ion transfer system, and a method for providing an ion stream within an ion transfer system are described that include using multiple concentric tubes with one tube disposed within the other tube. In an implementation, an ion transfer tube assembly that employs example techniques in accordance with the present disclosure includes a concentric ion transfer tube, the concentric ion transfer tube including a porous material that is permeable to a gas, and the first concentric ion transfer tube coupled to an ion inlet and an ion source, where a first gas that includes an ion stream flows through the concentric ion transfer tube to an ion detection device, and where the ion stream includes at least one of ions or neutral molecules, the neutral molecules ionizable subsequent to passing through the concentric ion transfer tube; and a concentric gas tube, the concentric ion transfer tube disposed within the concentric gas tube, where a second gas flows between the concentric ion transfer tube and the concentric gas tube in an annular space.

In an implementation, an ion transfer system that employs example techniques in accordance with the present disclosure includes an ion source coupled to an ion inlet; an ion transfer tube assembly including a concentric ion transfer tube, the concentric ion transfer tube including a porous material that is permeable to a gas, and the first concentric ion transfer tube coupled to an ion inlet and an ion source, where a first gas that includes an ion stream flows through the concentric ion transfer tube, and where the ion stream includes at least one of ions or neutral molecules, the neutral molecules ionizable subsequent to passing through the concentric ion transfer tube; and a concentric gas tube, the concentric ion transfer tube disposed within the concentric gas tube, where a second gas flows between the concentric ion transfer tube and the concentric gas tube in an annular space and permeates through the porous tubing; an ion detection device coupled to a capillary tube, the capillary tube coupled to the concentric ion transfer tube, where the capillary tube transports the ion stream from the concentric ion transfer tube to the ion detection device; and a pump coupled to at least one of the concentric ion transfer tube or the concentric gas tube.

In an implementation, a method for providing an ion stream within an ion transfer system that employs example techniques in accordance with the present disclosure includes providing the ion stream using an ion source, an ion inlet coupled to the ion source, from the ion inlet through a concentric ion transfer tube to a capillary tube coupled to a mass spectrometer, the ion stream flowing within a first gas from the ion inlet to the capillary tube, where the concentric ion transfer tube includes a porous material that is permeable to gas, and where the ion stream includes at least one of ions or neutral molecules, the neutral molecules ionizable subsequent to passing through the concentric ion transfer tube; and providing a second gas within a concentric gas tube, the concentric ion transfer tube within the concentric gas tube, where the second gas flows through an annular space disposed between the concentric ion transfer tube and the concentric gas tube and permeates into the concentric ion transfer tube.

In the above implementations, the loss of ions and neutral molecules on the walls of an ion transfer tube can be reduced by creating a flow of gas through the concentric ion transfer tube causing a flow within the concentric ion transfer tube that is radially inward and actively pushes ions and neutral molecules away from the tube wall. The net effect of the radially inward flow described above is the reduction of the total ion flux to the walls and reduced ion and neutral molecule losses resulting in a more accurate ion concentration measurement. The neutral molecules are ionized between the end of the transfer tube and a mass spectrometer entrance and/or within a mass spectrometer.

Example Implementations

FIGS. 1A through 1G illustrate an ion transfer tube assembly 100 and an ion transfer system 134 and flow characteristics in accordance with example implementations of the present disclosure. As shown, the ion transfer tube assembly 100 and the ion transfer system 134 can include an ion source 102, a concentric ion transfer tube 110, a concentric gas tube 112, and an ion detection device 120.

In implementations, the ion transfer system 134 can include an ion source 102 that provides an ion stream 128 and/or ionized neutral molecules to the ion detection device 120 for analysis. The ion stream can include at least one of ions or neutral molecules, where the neutral molecules are ionizable subsequent to passing through the concentric ion transfer tube. The ion source 102 can receive a substance (e.g., fluid, solid, etc.) and use the substance to produce ions and/or neutral molecules that are indicative of the composition of the substance to be analyzed. Some examples of an ion source 102 may include an electrospray ion source, a sonic spray ionization source, atmospheric pressure matrix-assisted laser desorption/ionization, nano-electrospray ionization, atmospheric pressure chemical ionization, desorption electrospray ionization (DESI), direct analysis in real-time (DART), direct atmospheric pressure chemical ionization (DAPCI), dielectric barrier discharge ionization, low-temperature plasma desorption ionization, and electrospray-assisted laser desorption ionization, an inductively-coupled plasma, a spark ion source, a corona discharge ion source, a radioactive ion source (e.g., $^{63}$Ni or $^{241}$Am), etc. In embodiments, the ion source 102 may generate ions and/or neutral molecules from an object of interest at atmospheric pressure, other pressures (e.g., a reduced pressure, high pressure, etc.), and/or ambient conditions (e.g., in situ). Additionally, the ion source 102 may be a remote ion source with varying distances between the ion source 102 and the ion detection device 120 (e.g., one meter, two meters, 5 meters, etc.).

As shown in FIGS. 1A and 1D through 1F, the ion source 102 can be coupled to an ion inlet 104 using an inlet tee 106 so that the ion stream 128 (e.g., ion beam, gas stream with ions, etc.), which can include ions and/or neutral molecules created and/or provided by the ion source 102 and carried by a gas (e.g., air), can travel through an ion inlet 104. In some embodiments, the ion inlet 104 may include a capillary tube. In one specific embodiment, the ion inlet 104 includes a heated capillary tube. In another specific embodiment, the ion inlet 104 includes a non-heated capillary tube. In some instances, the ion inlet 104 may have a constant diameter (e.g., a planar plate or cylinder) and/or a disparate diameter (e.g., a capillary with an inlet that is larger than the outlet). In the implementation shown in FIGS. 1A and 1D through 1F, the ion inlet 104 can extend from the ion source 102 and into the concentric ion transfer tube 110 such that the ion stream 128 exits the ion inlet 104 into the concentric ion transfer tube 110. In a specific embodiment, the ion inlet 104 can have a diameter between 0.25 mm and 1.50 mm. It is contemplated that the ion inlet 104 may have other diameter sizes and/or configurations (e.g., 0.15 mm, 3.5 mm, etc.).

As shown in FIGS. 1A and 1D through 1F, the ion transfer system 134 can include an ion transfer tube assembly 100, which further includes a concentric ion transfer tube 110 and a concentric gas tube 112. As described above, the concentric ion transfer tube 110 can be coupled to the ion source 102 using an ion inlet 104 and configured to contain a flowing first gas 126 and/or ion stream 128. In embodiments, the concentric ion transfer tube 110 may include a generally cylindrical and/or flexible tube that is porous and/or gas permeable and configured to contain a gas flow. The porosity of the concentric ion transfer tube 110 may range from a microscopic scale to a macroscopic scale. In one particular instance, the concentric ion transfer tube 110 can include a porosity of approximately 10 μm (e.g., the average pore is approximately 10 μm in diameter). It is contemplated that the porosity of the concentric ion transfer tube 110 can be on a variety of other scales (e.g., 1 μm, 25 μm, 50 μm, 100 μm, 500 μm, 1000 μm, etc.). In some embodiments, the concentric ion transfer tube 110 can include a membrane and/or a polymer tube. For example, the concentric ion transfer tube 110 may include a polytetrafluoroethylene (PTFE) (e.g., Teflon) based material. In some embodiments, the concentric ion transfer tube 110 may include other materials that are gas permeable and suitable for a gas flow, such as a metal. The concentric ion transfer tube 110 can generally extend from the ion source 102 and ion inlet 104 to an ion detection device 120 and gas inlet 122.

In implementations, the ion transfer tube assembly 100 can include a concentric gas tube 112, which can include a tube configured to contain a flowing second gas 130. The concentric ion transfer tube 110 is disposed within the concentric gas tube 112 such that the second gas 130 can flow between the concentric ion transfer tube 110 and the concentric gas tube 112 in an annular space 124 and can permeate through the wall of the concentric ion transfer tube 110, thereby actively reducing diffusion of the ions and/or neutral molecules to the walls of the concentric ion transfer tube 110 and reducing ion and/or neutral molecule losses. In some embodiments, a spacer may be disposed between the concentric ion transfer tube 110 and the concentric gas tube 112 to maintain the annular space 124 and allow for a suitable second gas 130 flow.

Figure 1B:
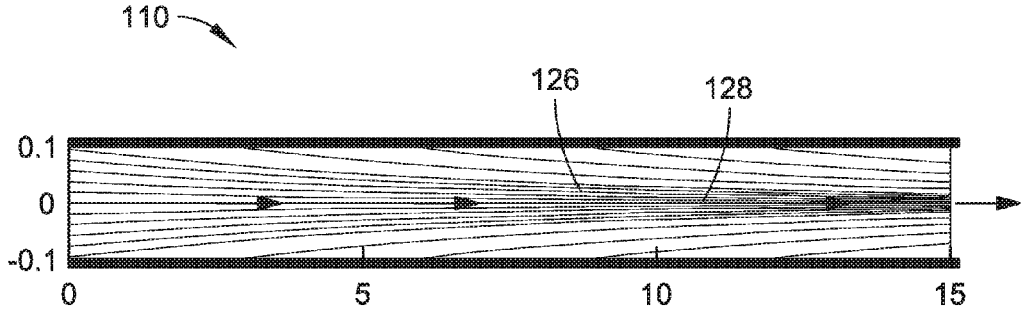
FIG. 1B is a graphical depiction of a streamline of gas flow within a porous concentric ion transfer tube in an ion transfer assembly in accordance with an example implementation of the present disclosure.
Figure 1C:
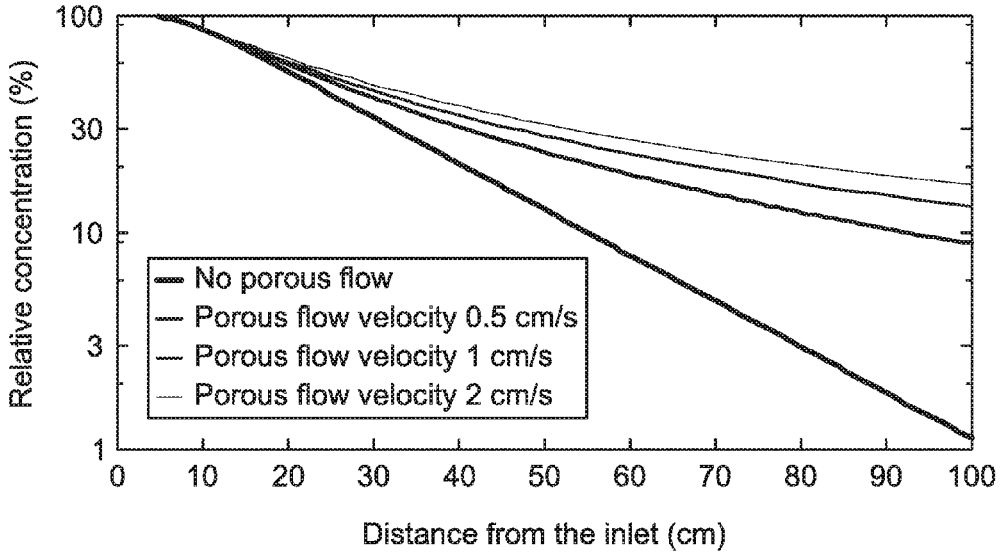
FIG. 1C is a graphical depiction of a set of calculated concentration profiles for various gas flow rates from a concentric gas tube through a porous concentric ion transfer tube in an ion transfer assembly in accordance with an example implementation of the present disclosure.
Figure 1D:
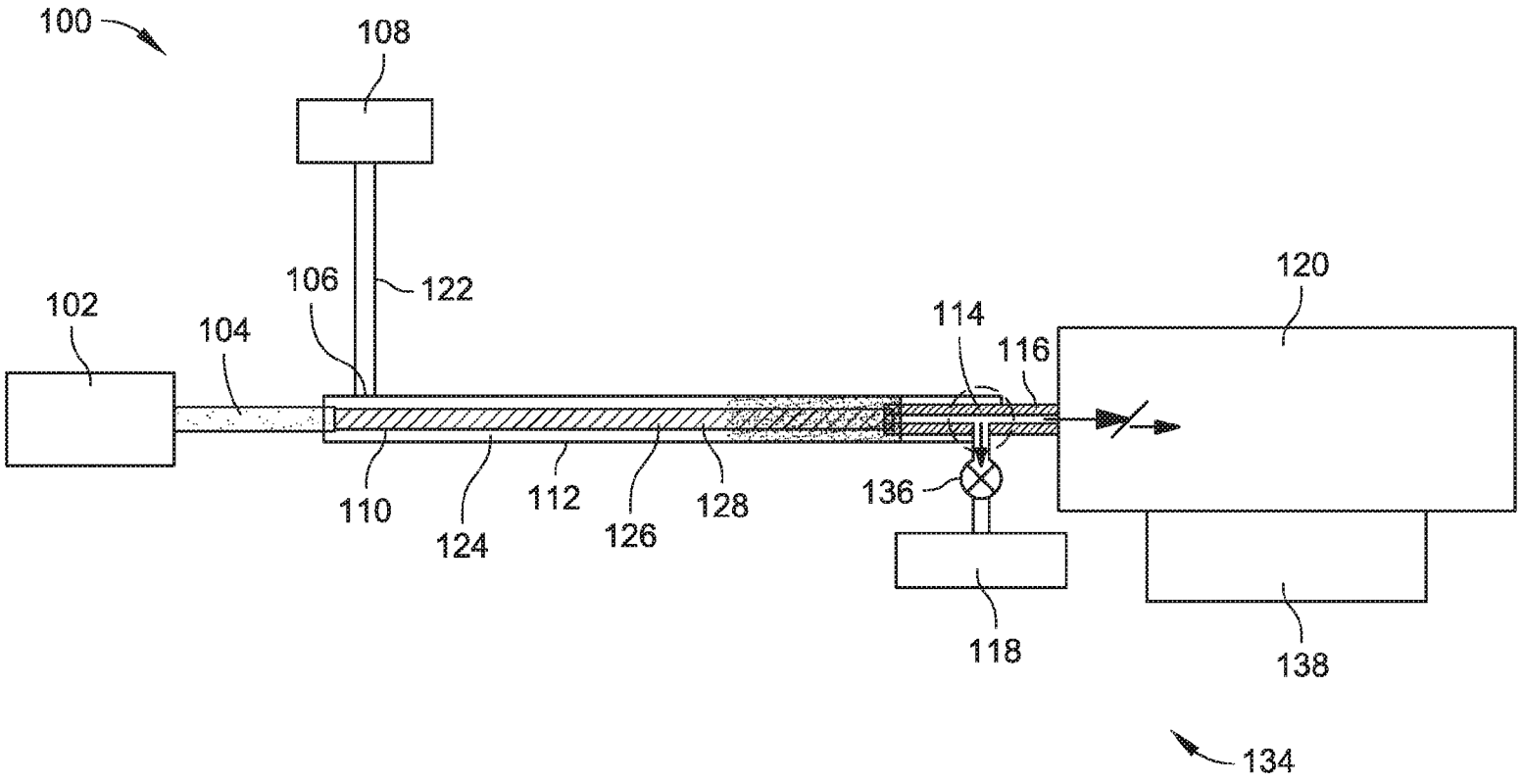
FIG. 1D is a diagrammatic cross-sectional view illustrating an ion transfer system and ion transfer tube assembly including a porous concentric ion transfer tube within a concentric gas tube in accordance with an example implementation of the present disclosure.

As shown in FIGS. 1A and 1D, a gas supply 108 may be coupled to the ion transfer tube assembly 100 and concentric gas tube 112 by way of a gas inlet 122. In these implementations, the gas supply 108 can be configured to provide a second gas 130 (e.g., air, argon, etc.) to the concentric gas tube 112. Some examples of a gas supply 108 may include a fan, a compressor, and/or a compressed gas tank. Additionally, the gas supply 108 may include a flow and/or pressure control element that may be controllable by a controller (e.g., controller 144), such as a pressure regulator, a valve, and/or a variable speed .pump.

Figure 1E:
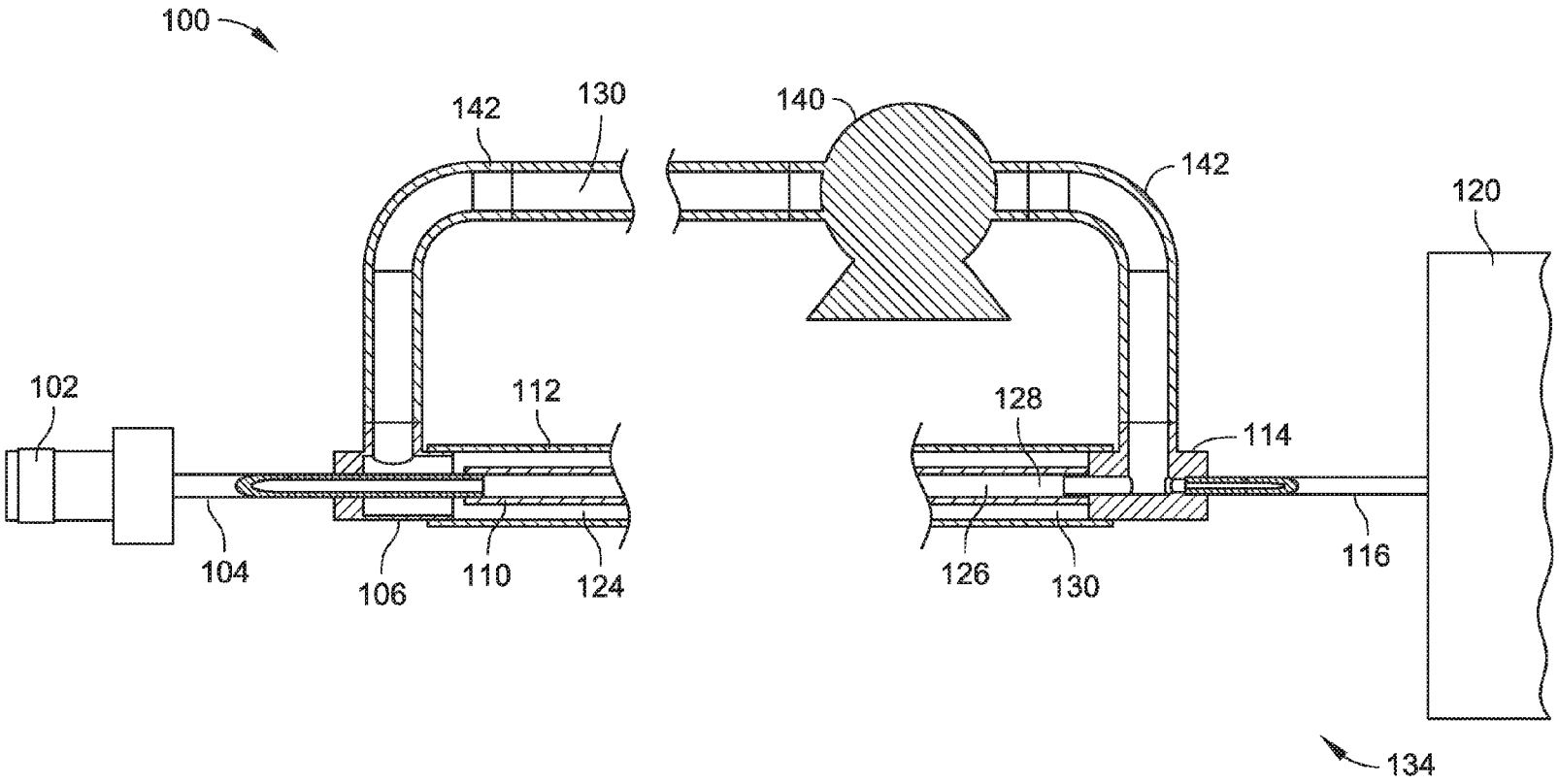
FIG. 1E is a diagrammatic cross-sectional view illustrating an ion transfer system and ion transfer tube assembly including a porous concentric ion transfer tube within a concentric gas tube in accordance with an example implementation of the present disclosure.
Figure 1F:
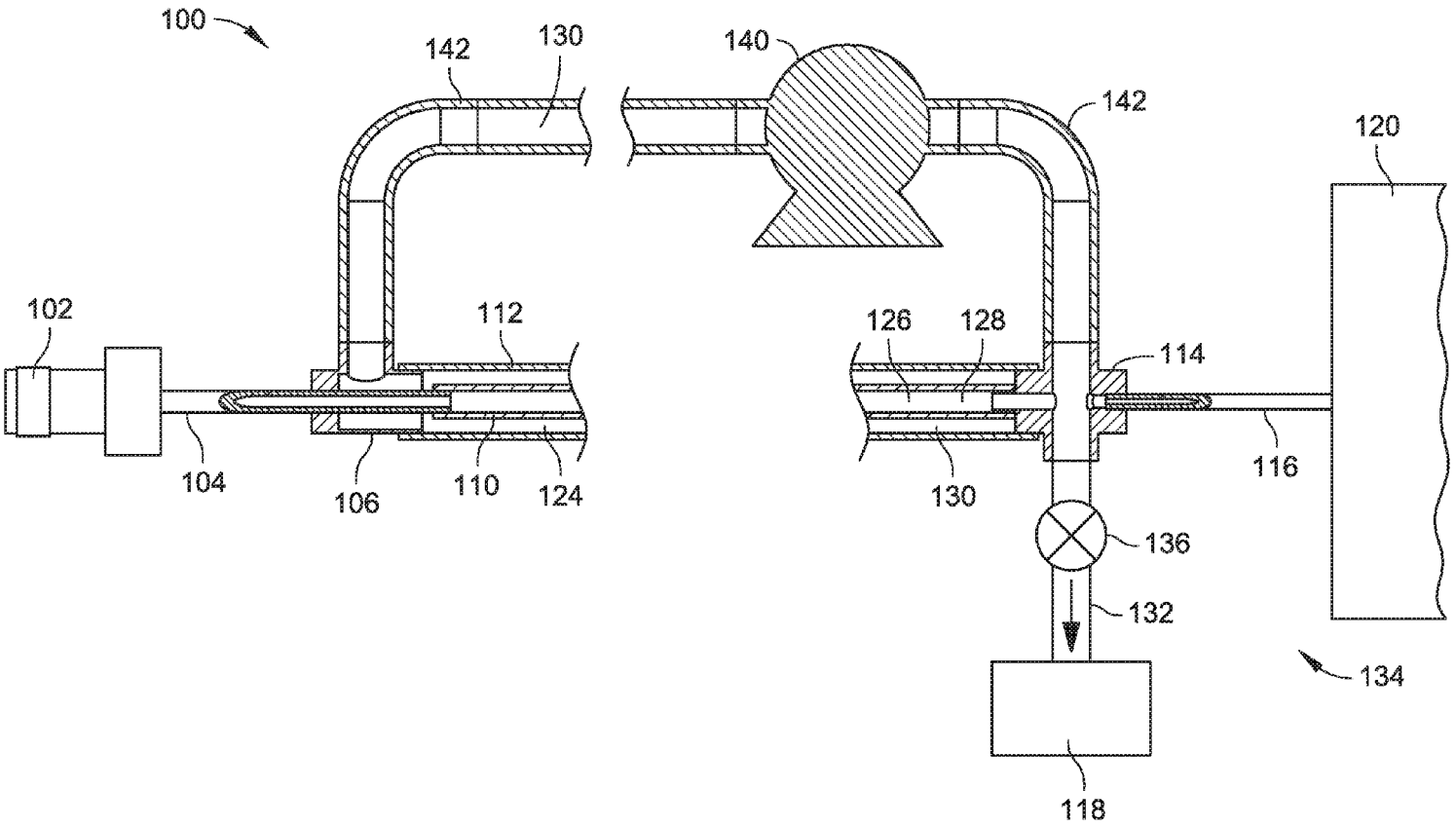
FIG. 1F is a diagrammatic cross-sectional view illustrating an ion transfer system and ion transfer tube assembly including a porous concentric ion transfer tube within a concentric gas tube in accordance with an example implementation of the present disclosure.

In the exemplary embodiments illustrated in FIGS. 1E and 1F, the second gas 130 may be provided to the concentric gas tube 112 by a recirculating pump 140 through a recirculation tube 142. In one specific embodiment, a flow of the second gas 130 can flow from the recirculating pump 140 through the recirculation tube 142 at a location proximate to the ion inlet 104, through the concentric gas tube 112 and back to the recirculation tube 142 at a location proximate to the capillary tube 116 and/or the gas outlet 132. In another specific embodiment, the flow of second gas 130 can flow from the recirculation tube 142 at a location proximate to the capillary tube 116 and/or the gas outlet 132 against the direction of flow of the first gas 126 in the concentric ion transfer tube 110 to an inlet tee 106.

In operation of the ion transfer tube assembly 100, ions and/or neutral molecules are drawn into the ion inlet 104 tubing resulting in the ion stream 128 and carried along the concentric ion transfer tube 110 by the flowing first gas 126 (e.g., air). Concurrently, the second gas 130 (e.g., air, argon, etc.) flows through the annular space 124 between the concentric gas tube 112 and the concentric ion transfer tube 110 and a portion of the second gas 130 permeates through the concentric ion transfer tube 110 into the flow of the first gas 126 and/or ion stream 128. The permeated second gas 130 enters the concentric ion transfer tube 110 radially inward, thus actively pushing the ions, neutral molecules, and/or ion stream 128 away from the walls of the concentric ion transfer tube 110 where the ions could lose their charge and the neutral molecules could be absorbed onto the surface or absorbed by the bulk of the concentric ion transfer tube 110. The net effect of the radially inward diffusion of the permeated second gas 130 includes the reduction of the total ion and/or neutral molecule flux to the walls and reduced ion and neutral molecule losses. At the end of the porous tubing, the ion stream 128 enters the ion detection device 120 (e.g., a mass spectrometer) and the excess gas (e.g., the first gas 126, second gas 130, ion stream 128, etc.) can be pumped away by the low vacuum pump 118. Additionally, neutral molecules may be ionized at the end of the porous tubing and concentric ion transfer tube 110 and/or subsequent to entering an analysis device (e.g., mass spectrometer) coupled to the concentric ion transfer tube 110.

FIG. 1B illustrates an exemplary flow profile of the total gas flow (e.g., first gas 126, ion stream 128, neutral molecules etc.) within the concentric ion transfer tube 110. In this example, the ion inlet 104 is located on the left side of the figure. The incoming first gas 126, the ion stream 128, and/or the neutral molecules are progressively squeezed by the permeating second gas 130 flow (e.g., the second gas 130 generally diffuses perpendicularly to the wall of the concentric ion transfer tube 110) from the walls towards the center of the concentric ion transfer tube 110. Thus, ions and/or neutral molecules that are diffusing across the streamlines (toward the concentric ion transfer tube 110 walls) are being constantly pushed back towards the center of the tubing and away from the walls by the permeating second gas 130.

FIG. 1C illustrates several calculated axial concentration profiles for various flow velocities of the second gas 130 permeating through the wall of the concentric ion transfer tube 110. In the calculations shown in FIG. 1C, a porous 100 cm concentric ion transfer tube 110 is used in accordance with the calculated profiles. The concentrations are expressed as a percentage of the initial ion and/or neutral molecule concentration at the ion inlet 104. The addition of the inward permeating second gas 130 flowing through the concentric ion transfer tube 110 increases the concentration of the ions and/or the ionized neutral molecules in the ion stream 128 at the ion detection device 120 from about 1.1% (with no second gas 130 permeation flow through the concentric ion transfer tube 110) to about 16% (with a 2 cm/s second gas 130 permeation flow through the concentric ion transfer tube 110). As the flow rate of the permeation of the second gas 130 through the concentric ion transfer tube 110 increases, the increase in detected ion and/or ionized neutral molecule concentration by the ion detection device 120 proportionally diminishes due to dilution of the ions and/or neutral molecules by the addition of the second gas 130 to the overall gas flow in the concentric ion transfer tube 110.

FIGS. 1A and 1D through 1G illustrate an ion detection device 120 configured to receive an ion sample from ion stream 128 by way of a capillary tube 116. The capillary tube 116 may be disposed in and/or coupled to the concentric ion transfer tube 110 and exposed to the ion stream 128. In some instances, neutral molecules can be ionized between the concentric ion transfer tube 110 and the capillary tube 116. The ions and/or ionized neutral molecules from the ion stream 128 can then continue through the capillary tube 116 to the ion detection device 120. In one specific implementation, the capillary tube 116 may include a diameter of about 0.5 mm. It is contemplated that the capillary tube 116 may include other diameters and/or configurations (e.g., 0.25 mm, 0.6 mm, cylindrical, differing diameters, a constant diameter, etc.).

Additionally, a gas outlet 132 can be coupled to the concentric ion transfer tube 110 and/or the concentric gas tube 112 at an outlet tee 114. The gas outlet 132 may be fabricated from materials such as a polymer, metal, and/or glass. In some implementations, as shown in FIGS. 1D and 1F, the gas outlet 132 can include a valve 136 and can be fluidly coupled to a pump 118 (e.g., a low vacuum pump). In some implementations, the valve 136 may be intermittently opened and closed to form a large gas flow rate and a small gas flow rate, respectively, through the concentric ion transfer tube 110. In these implementations, the gas outlet 132 can be configured to facilitate a first gas flow rate (e.g., 2.0 L/min, 1.0 L/min, etc.) that is higher than a second gas flow rate (e.g., 0.15 L/min) to create an ion plug (e.g., a portion of the first gas 126 and/or ion stream 128 that is rich in ions). Some examples of a valve 136 may include a ball valve and/or a needle valve. Additionally, the valve may include an actuator (e.g., electric, pneumatic, etc.). The valve 136 may be communicably coupled to a controller 144, which can control the position (e.g., open, shut, partially shut, etc.) of the valve 136.

As illustrated in FIGS. 1A, 1D, and 1F, pump 118 may be in fluid communication with the concentric ion transfer tube 110, the concentric gas tube 112, and/or the gas outlet 132. In implementations, the pump 118 can be configured to pump and evacuate a gas flow (e.g., first gas 126, ion stream 128, second gas 130, etc.) through the ion transfer tube assembly 100 and/or the gas outlet 132. Some examples of the pump 118 can include a low vacuum pump, a scroll pump, a diaphragm pump, a compressor, or any pump suitable to provide a sufficient gas flow through the ion transfer tube assembly 100 and/or the gas outlet 132. When a valve 136 is included, the pump 118 may be configured to provide a high gas flow (e.g., 1.0 L/min) through the concentric ion transfer tube 110 and/or the gas outlet 132 in instances that the valve 136 is in an open position. In some embodiments, the pump 118 may include a vent and/or other means for venting/evacuating the gas flow from the gas outlet 132 to the atmosphere. In one specific implementation, the pump 118 can include a vacuum pump configured to pump the gas flow from the gas outlet 132 and to vent the gas stream into the atmosphere. The pump 118 can be coupled to a controller 144, which can be configured to control the pump 118.

In implementations, the ion detection device 120 can include a mass spectrometer that separates ionized masses based on charge to mass ratios and outputs the ionized masses to a detector. Some examples of an ion detection device 120 and/or mass spectrometer can include a quadrupole mass analyzer, a time of flight (TOF) mass analyzer, a magnetic sector mass analyzer, an electrostatic sector mass analyzer, a quadrupole ion trap mass analyzer, etc. Some examples of a detector that can be used in the ion detection device 120 and/or mass spectrometer can include an electron multiplier, Faraday cups, and/or ion-to-photon detectors. The ion detection device 120 can be coupled to controller 144, which can control the ion detection device 120.

Additionally, a pump 138 can be coupled to the ion detection device 120 and/or controller 144. In some implementations, pump 138 can include a high vacuum pump. A vacuum, at least partially created by a high vacuum pump, such as pump 138, can reduce and/or eliminate ion-molecule collisions within the ion detection device 120 that may otherwise reduce the effectiveness of the mass spectrometer at separating elements based on their mass-to-charge ratios because molecular collisions may significantly alter the trajectories of the ionized neutral molecules and/or ions involved and result in less ions/molecules of a desired mass/charge reaching the detector of the mass spectrometer. In instances when a valve 136 is included in the ion transfer system 134, the pump 138 can create a vacuum within the ion detection device 120 that can draw in an ion sample (e.g., 0.2 L/min) from an ion stream 128 and/or an ion plug disposed in the concentric ion transfer tube 110 and/or the capillary tube 116 when the valve 136 is in a closed configuration and the ion detection device 120 is in an ion injection cycle/mode. In embodiments, the pump 138 can be coupled to a vacuum chamber of the ion detection device 120 that requires a high vacuum (e.g., low pressure). For example, the pump 138 may be coupled to a vacuum chamber of the ion detection device 120 (e.g., requiring approximately $10^{-3}$ Torr). In one specific implementation, the pump 138 may include, for example, a turbomolecular vacuum pump.

The ion transfer system 134 and ion transfer tube assembly 100 can be configured to provide a gas flow that minimizes and/or prevents ion and/or neutral molecule losses to walls of the concentric ion transfer tube 110, especially over long distances from the ion source 102 to the ion detection device 120. In the embodiments shown in FIGS. 1D and 1F and during the mass analysis portion of the ion detection device 120 cycle, controller 144 can open the valve 136 and pump 118 can create a large gas flow (e.g., 1.0 L/min) through the concentric ion transfer tube 110, the concentric gas tube 112, and/or gas outlet 132. When the gas flow is large, ion losses due to diffusion to the walls of the concentric ion transfer tube 110 are minimized due to the large flow rate and to the radially inward gas profile in the concentric ion transfer tube 110. During ion injection into the ion detection device 120, controller 144 can close (or partially close) valve 136, which creates a small gas flow (e.g., less than the large gas flow described above, e.g., 0.2 L/min) through the concentric ion transfer tube 110 and/or the concentric gas tube 112. In this instance, the small gas flow does not travel/exit through the gas outlet 132 and/or the valve 136. When the gas flow is small, the gas flow is determined by the ion detection device 120, the pump 138, and/or controller 144. The small gas flow transfers only a small portion of ion stream 128 from concentric ion transfer tube 110, referred to as an ion plug with a high ion concentration, that is proximate to the portion of the concentric ion transfer tube 110 coupled to the capillary tube 116 because of the ions and/or neutral molecules brought by the large flow. Subsequent to ion injection by the ion detection device 120, controller 144 can open the valve 136 to create a high gas flow which moves the ions and/or neutral molecules from ion source 102 without significant losses through concentric ion transfer tube 110. In these instances, the intermittent gas flow created by cycling the large gas flow and the small gas flow previously described prevents ion and/or neutral molecule losses to the walls of the concentric ion transfer tube 110, especially in the case of a remote ion source 102 and/or large distances between the components of the ion transfer system 134.

Figure 1G:
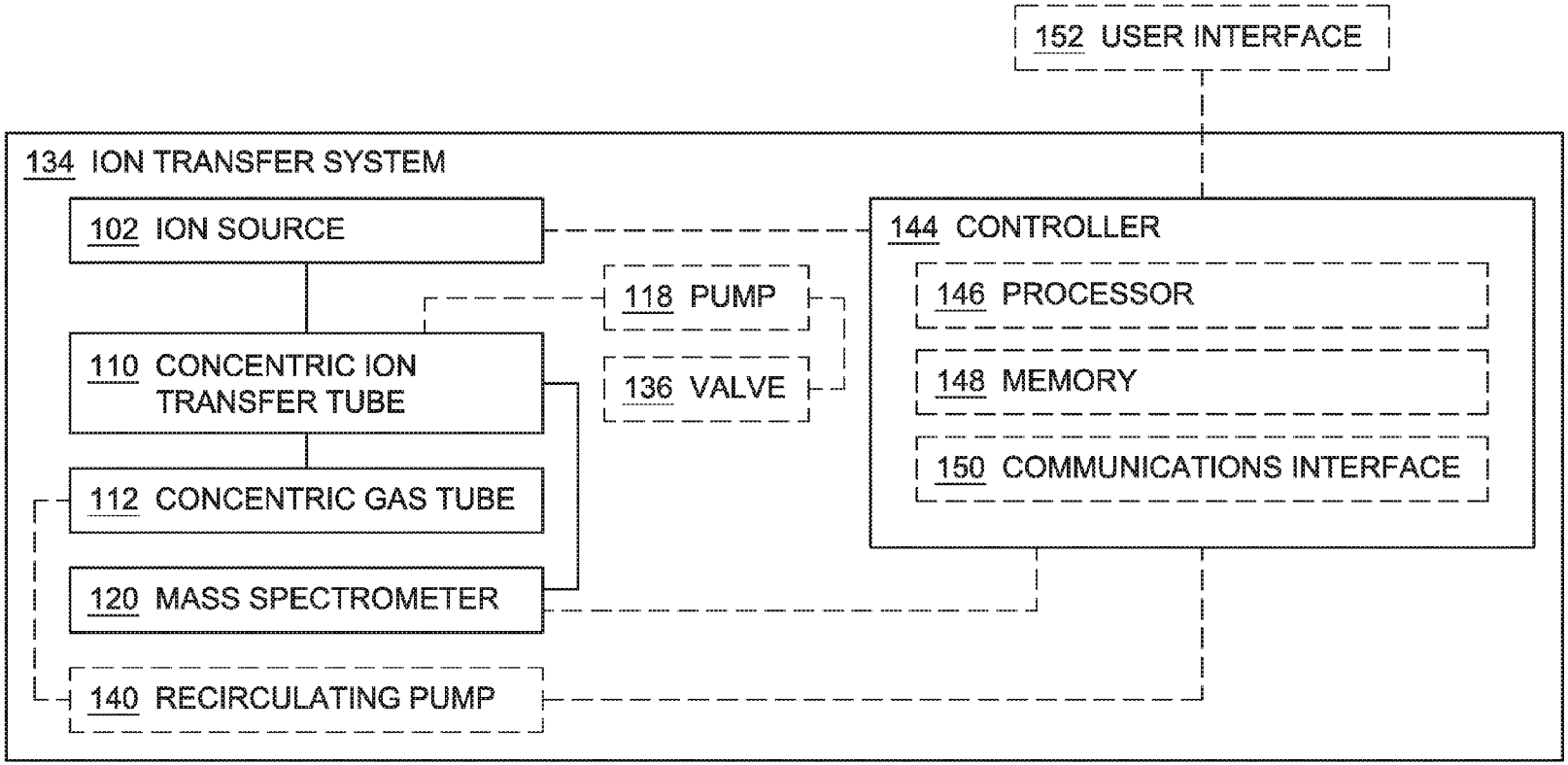
FIG. 1G is an environmental block diagram illustrating an ion transfer system including an ion transfer tube assembly in accordance with an example implementation of the present disclosure.

Referring to FIG. 1G, the ion transfer system 134, including some or all components, can operate under computer control. For example, a processor 146 can be included with or in the ion transfer system 134 and/or controller 144 to control the components and functions of the ion transfer system 134 described herein using software, firmware, hardware (e.g., fixed logic circuitry), manual processing, or a combination thereof. The terms "controller," "functionality," "service," and "logic" as used herein generally represent software, firmware, hardware, or a combination of software, firmware, or hardware in conjunction with controlling the ion transfer system 134. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

Illustrated in FIG. 1G, the ion transfer system 134 and component(s) included therein can be coupled with a controller 144 for controlling the ion transfer system 134. The controller 144 can include a processor 146, a memory 148, and a communications interface 150. In some embodiments, the controller 144 may be integrated into and/or include an integrated circuit (IC) with a user interface 152 (e.g., controls, a readout, etc.) for the ion transfer system 134. In other embodiment, the controller 144, processor 146, memory 148, communications interface 150, and/or user interface 152 may be integrated into one system-in-package/module and/or one or more could be separate discrete components in an end system (e.g., ion transfer system 134).

The processor 146 provides processing functionality for the ion transfer system 134 and/or controller 144 and can include any number of processors, micro-controllers, or other processing systems, and resident or external memory for storing data and other information accessed or generated by the ion transfer system 134 and/or controller 144. The processor 146 can execute one or more software programs that implement techniques described herein. The processor 146 is not limited by the materials from which it is formed or the processing mechanisms employed therein and, as such, can be implemented via semiconductor(s) and/or transistors (e.g., using electronic integrated circuit (IC) components), and so forth.

The controller 144 may include a memory 148. The memory 148 can be an example of tangible, computer-readable storage medium that provides storage functionality to store various data associated with operation of the ion transfer system 134 and/or controller 144, such as software programs and/or code segments, or other data to instruct the processor 146, and possibly other components of the ion transfer system 134 and/or controller 144, to perform the functionality described herein. Thus, the memory 148 can store data, such as a program of instructions for operating the ion transfer system 134 (including its components), and so forth. It should be noted that while a single memory 148 is described, a wide variety of types and combinations of memory (e.g., tangible, non-transitory memory) can be employed. The memory 148 can be integral with the processor 146, can comprise stand-alone memory, or can be a combination of both. In specific instances, the memory 148 may include a buffer (e.g., a region of a physical memory storage used to temporarily store data while it is being moved from one place to another) and/or datalog for storing sensor data.

The memory 148 can include, but is not necessarily limited to removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In implementations, the ion transfer system 134 and/or the memory 148 can include removable integrated circuit card (ICC) memory, such as memory provided by a subscriber identity module (SIM) card, a universal subscriber identity module (USIM) card, a universal integrated circuit card (UICC), and so on.

The controller 144 may include a communications interface 150. The communications interface 150 can be operatively configured to communicate with components of the ion transfer system 134. For example, the communications interface 150 can be configured to transmit data for storage in the ion transfer system 134, retrieve data from storage in the ion transfer system 134, and so forth. The communications interface 150 can also be communicatively coupled with the processor 146 to facilitate data transfer between components of the ion transfer system 134 and the processor 146 (e.g., for communicating inputs to the processor 146 received from a device communicatively coupled with the ion transfer system 134 and/or controller 144). It should be noted that while the communications interface 150 is described as a component of an ion transfer system 134 and/or controller 144, one or more components of the communications interface 150 can be implemented as external components communicatively coupled to the ion transfer system 134 via a wired and/or wireless connection. The ion transfer system 134 can also include and/or connect to one or more input/output (I/O) devices (e.g., via the communications interface 150), including, but not necessarily limited to a display, a mouse, a touchpad, a keyboard, and so on.

The communications interface 150 and/or the processor 146 can be configured to communicate with a variety of different networks, including, but not necessarily limited to a wide-area cellular telephone network, such as a 3G cellular network, a 4G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface 150 can be configured to communicate with a single network or multiple networks across different access points.

Generally, any of the functions described herein can be implemented using hardware (e.g., fixed logic circuitry such as integrated circuits), software, firmware, manual processing, and/or a combination thereof. Thus, the blocks discussed in this disclosure generally represent hardware (e.g., fixed logic circuitry such as integrated circuits), software, firmware, or a combination thereof. In the instance of a hardware configuration, the various blocks discussed in the above disclosure may be implemented as integrated circuits along with other functionality. Such integrated circuits may include all of the functions of a given block, system, or circuit, or a portion of the functions of the block, system, or circuit. Further, elements of the blocks, systems, or circuits may be implemented across multiple integrated circuits. Such integrated circuits may comprise various integrated circuits, including, but not necessarily limited to a monolithic integrated circuit, a flip chip integrated circuit, a multichip module integrated circuit, and/or a mixed signal integrated circuit. In the instance of a software implementation, the various blocks discussed in the above disclosure represent executable instructions (e.g., program code) that perform specified tasks when executed on a processor. These executable instructions can be stored in one or more tangible computer readable media. In some such instances, the entire system, block, or circuit may be implemented using its software or firmware equivalent. In other instances, one part of a given system, block, or circuit may be implemented in software or firmware, while other parts are implemented in hardware. In a specific embodiment, an analysis function or other parts and functions of the ion transfer system 134 can be implemented on a remote system (e.g., a server).

Further, the ion transfer system 134 may include a user interface 152. In implementations, a user interface 152 can include a device configured to display and/or communicate information to a user. For example, a user interface 152 can include a display screen and/or a touch screen. In one specific embodiment, ion transfer system 134 includes a user interface 152 that further includes a touch screen that is coupled to controller 144 and is configured to present sensor information to a user. In this specific embodiment, the user interface 152 may also receive input from a user and transmit the input to controller 144.

Example Processes

Figure 2:
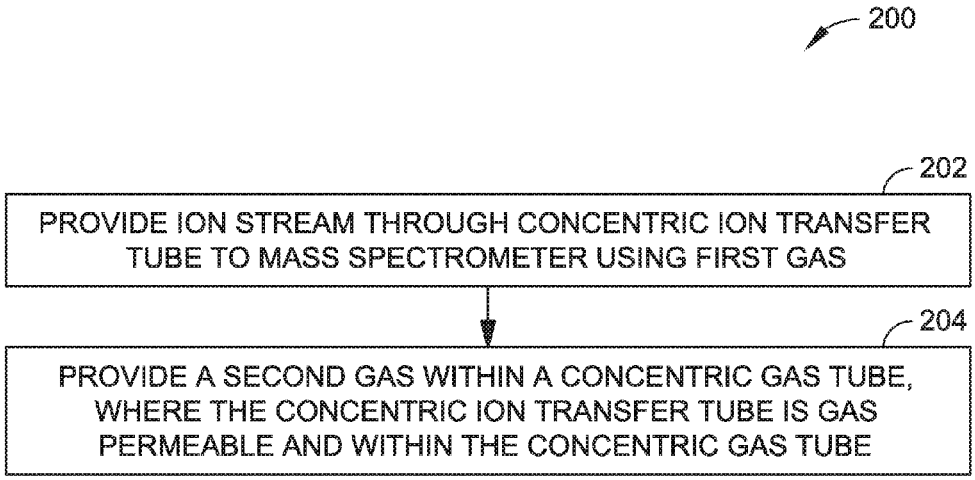
FIG. 2 is a flow diagram illustrating a method for providing an ion stream using the ion transfer system and ion transfer tube assembly illustrated in FIGS. 1A and 1D through 1G in accordance with an example implementation of the present disclosure.

FIG. 2 illustrates an example process 200 that employs the disclosed techniques to employ an ion analysis system with an ion transfer tube assembly 100 and/or an ion detection device 120, such as the ion transfer system 134 shown in FIGS. 1A and 1D through 1G.

Accordingly, an ion stream is provided using an ion source and a first gas through a porous concentric ion transfer tube (Block 202). The ion stream can include at least one of ions or neutral molecules, where the neutral molecules are ionizable subsequent to passing through the concentric ion transfer tube. In implementations, producing an ion stream 128 including a sample of ions and/or neutral molecules from an object of interest can include, for example, using an ion source 102 (e.g., electrospray ionization, inductively-coupled plasma, spark ionization, a corona source, low-temperature plasma ionization, a radioactive source (e.g., 63Ni), etc.) to produce ions, which are subsequently introduced into ion inlet 104 and/or concentric ion transfer tube 110 with a gas flow (e.g., air, first gas 126, etc.). In one specific embodiment, producing a sample of ions and/or neutral molecules includes using an ion source 102 including an electrode and a low-temperature plasma ionization process. In another embodiment, providing an ion stream 128 can include using a corona discharge ion source 102 that utilizes a corona discharge surrounding a conductor to produce the sample of ions and/or neutral molecules from the object of interest. In another embodiment, providing an ion stream 128 can include using electrospray ionization to produce the sample of ions. Electrospray ionization may include applying a high voltage to a sample through an electrospray needle, which emits the sample in the form of an aerosol. The aerosol then traverses the space between the electrospray needle and a cone while solvent evaporation occurs, which results in the formation of ions. It is contemplated that providing an ion stream 128 may include using other types of an ion source 102. High vacuum pump 138 and/or ion detection device 120 can provide a vacuum that causes the first gas 126 and/or ion stream 128 to flow through the concentric ion transfer tube 110, which in turn can draw in ions and/or neutral molecules formed by the ion source 102. Controller 144 can control the high vacuum pump 138 and/or ion detection device 120 and determine the rate of flow of the first gas 126 and/or ion stream 128. In a specific embodiment, high vacuum pump 138 can create a gas flow of 0.20 L/min that provides ion stream 128 to the capillary tube 116 and/or ion detection device 120.

A second gas is provided to a concentric gas tube (Block 204). In implementations, providing a second gas 130 can include using a gas supply 108 and/or a recirculating pump 140 to create and/or provide a flowing second gas 130. In some embodiments, such as that illustrated in FIG. 1D, the valve 136 can be opened and/or closed to at least partially determine the rate of flow of the second gas 130. In other embodiments, such as those illustrated in FIGS. 1E and 1F, a recirculating pump 140 can provide a second gas 130 to and from the concentric gas tube 112 using a recirculation tube 142. In these embodiments, the recirculation tube 142 can provide the second gas 130 at a location proximate to the ion inlet 104 and/or proximate to the capillary tube 116 depending on the desired direction of flow of the second gas 130 within the annular space 124, and the second gas 130 can return to the recirculation tube 142 at the respective other location (e.g., proximate to the ion inlet 104 or the capillary tube 116).

As the first gas 126, neutral molecules, and/or the ion stream 128 flows through the concentric ion transfer tube 110, the second gas 130 simultaneously flows through the concentric gas tube 112 and the annular space 124. A portion of the second gas 130 permeates perpendicularly through the porous concentric ion transfer tube 110 and pushes the ions and/or the neutral molecules in the ion stream 128 and/or the first gas 126 away from the wall of the concentric ion transfer tube 110. Thus, the ions and/or the neutral molecules in the ion stream 128 remain along the cross-sectional center of the concentric ion transfer tube 110. Using the ion transfer tube assembly 100 to create and maintain this streamlined first gas 126 and ion stream 128 flow minimizes ion and/or the neutral molecule loss and results in more accurate ion detection.

Although the invention has been described in language specific to structural features and/or methodological acts, it is to be understood that the invention defined in the appended claims is not necessarily limited to the specific features or acts described. Although various configurations are discussed the apparatus, systems, subsystems, components and so forth can be constructed in a variety of ways without departing from this disclosure. Rather, the specific features and acts are disclosed as example forms of implementing the claimed invention.

What is claimed is:

1. An ion transfer tube assembly, comprising:

a concentric ion transfer tube, the concentric ion transfer tube including a porous material that is gas permeable, and the concentric ion transfer tube coupled to an ion inlet and an ion source, where a first gas that includes an ion stream flows through the concentric ion transfer tube to an ion detection device, and where the ion stream includes at least one of ions or neutral molecules, the neutral molecules ionizable subsequent to passing through the concentric ion transfer tube; and a concentric gas tube, the concentric ion transfer tube disposed within the concentric gas tube, where a second gas flows between the concentric ion transfer tube and the concentric gas tube in an annular space, and where a portion of the second gas permeates the concentric ion transfer tube in a radial configuration.

2. The ion transfer tube assembly in claim 1, where the ion source includes at least one of a desorption electrospray ionization (DESI), a direct analysis in real-time (DART) ionization, a low-temperature plasma (LTP) ionization, or a direct atmospheric pressure chemical ionization (DAPCI).

3. The ion transfer tube assembly in claim 1, where the concentric ion transfer tube is porous.

4. The ion transfer tube assembly in claim 1, where the concentric ion transfer tube is gas permeable.

5. The ion transfer tube assembly in claim 1, where the ion detection device includes a mass spectrometer.

6. The ion transfer tube assembly in claim 1, further comprising a pump coupled to at least one of the concentric ion transfer tube or the concentric gas tube, where the pump includes at least one of a pump or a compressor.

7. The ion transfer tube assembly in claim 1, further comprising:

a recirculation pump coupled to a recirculation tube, where the recirculation tube is fluidly coupled to the concentric gas tube, and the recirculation pump provides a recirculating second gas flow through the recirculation tube and the concentric gas tube.

8. An ion transfer system, comprising:

an ion source coupled to an ion inlet;

an ion transfer tube assembly including a concentric ion transfer tube, the concentric ion transfer tube including a porous material that is gas permeable, and the concentric ion transfer tube coupled to the ion inlet, where a first gas that includes an ion stream flows through the concentric ion transfer tube, and where the ion stream includes at least one of ions or neutral molecules, the neutral molecules ionizable subsequent to passing through the concentric ion transfer tube; and a concentric gas tube, the concentric ion transfer tube disposed within the concentric gas tube, where a second gas flows between the concentric ion transfer tube and the concentric gas tube in an annular space and permeates through the porous tubing;

an ion detection device coupled to a capillary tube, the capillary tube coupled to the concentric ion transfer tube, where the capillary tube transports the ion stream from the concentric ion transfer tube to the ion detection device; and a pump coupled to at least one of the concentric ion transfer tube or the concentric gas tube.

9. The ion transfer system in claim 8, where the ion source include at least one of a desorption electrospray ionization (DESI), a direct analysis in real-time (DART) ionization, a low-temperature plasma (LTP) ionization, or an atmospheric pressure chemical ionization (DAPCI).

10. The ion transfer system in claim 8, where the capillary includes a heated capillary.

11. The ion transfer system in claim 8, where the concentric ion transfer tube includes a polymer.

12. The ion transfer system in claim 8, where the concentric ion transfer is at least one of porous or gas permeable.

13. The ion transfer system in claim 8, where the ion detection device includes a mass spectrometer.

14. The ion transfer system in claim 8, where the pump includes at least one of a pump or a compressor.

15. The ion transfer system in claim 8, further comprising:

a recirculation pump coupled to a recirculation tube, where the recirculation tube is fluidly coupled to the concentric gas tube, and the recirculation pump provides a recirculating second gas flow through the recirculation tube and the concentric gas tube.

16. The ion transfer system in claim 8, further comprising:

a controller coupled to at least one of the ion source or the ion detection device.

17. A method for providing an ion stream within an ion transfer system, comprising:

providing the ion stream using an ion source, an ion inlet coupled to the ion source, from the ion inlet through a concentric ion transfer tube to a capillary tube coupled to a mass spectrometer, the ion stream flowing within a first gas from the ion inlet to the capillary tube, where the concentric ion transfer tube includes a porous material that is permeable to gas, and where the ion stream includes at least one of ions or neutral molecules, the neutral molecules ionizable subsequent to passing through the concentric ion transfer tube; and providing a second gas within a concentric gas tube, the concentric ion transfer tube within the concentric gas tube, where the second gas flows through an annular space disposed between the concentric ion transfer tube and the concentric gas tube and permeates into the concentric ion transfer tube.

18. The method for delivering an ion stream to a mass spectrometry system in claim 17, where the ion transfer tube includes a polymer.

19. The method for delivering an ion stream to a mass spectrometry system in claim 17, where providing a second gas includes providing a recirculated second gas stream using a recirculation pump.

20. The method for delivering an ion stream to a mass spectrometry system in claim 17, further comprising:

evacuating at least one of the first gas or the second gas using a pump coupled to at least one of the concentric ion transfer tube or the concentric gas tube.

* * * * *